United States Patent [19]

Phelps

[11] Patent Number: 5,009,347

[45] Date of Patent: Apr. 23, 1991

[54] WRIST HOLSTER

[76] Inventor: Bill E. Phelps, Box 2595, Jackson, Wyo. 83001

[21] Appl. No.: 474,629

[22] Filed: Jan. 29, 1990

Related U.S. Application Data

[63] Continuation of Ser. No. 266,396, Nov. 12, 1988, abandoned.

[51] Int. Cl.[5] ..... A45C 11/00

[52] U.S. Cl. ..... 224/219; 224/221; 224/236; 224/239; 224/267; 224/901

[58] Field of Search ..... 224/164, 165, 191, 218, 224/219, 220, 221, 222, 224, 235, 236, 239, 252, 267, 901, 911, 918; 2/160, 161 R, 161 A, 162, 170; 206/86, 102; 273/54 B

[56] References Cited

U.S. PATENT DOCUMENTS

| | | | |
|---|---|---|---|
| D. 33,980 | 1/1901 | Mitchell | 224/219 |
| D. 256,266 | 8/1980 | Sorgnard | D3/100 |
| D. 291,503 | 8/1987 | Hayes | D3/100 |
| 1,434,775 | 11/1922 | Fenno | 224/224 |
| 1,728,679 | 9/1929 | Hansard | 273/54 B |
| 3,333,850 | 8/1964 | Miller | 273/54 B |
| 4,193,135 | 3/1980 | Rhee | 2/162 |
| 4,239,136 | 12/1980 | Godwin | 224/219 |
| 4,303,154 | 12/1981 | Hicks | 206/86 |
| 4,337,496 | 6/1982 | Laird | 273/84 ES |
| 4,415,106 | 11/1983 | Connell et al. | 224/221 |
| 4,504,980 | 3/1985 | Butcher | 224/901 |
| 4,588,076 | 5/1986 | Caputo et al. | 206/86 |
| 4,852,729 | 8/1989 | Conte | 206/86 |

*Primary Examiner*—Henry J. Recla
*Assistant Examiner*—Glenn T. Barrett
*Attorney, Agent, or Firm*—Julian Caplan

[57] ABSTRACT

A wrist holster including a wristband, a transversely extending pouch for accommodating a canister for a protective gas, a foldback closure for the pouch secured by a pressure sensitive fastener, an extended strap at one end of the wristband, a buckle carried by the end of the wristband opposite the extended strap, and a pressure sensitive fastener for securing the extended strap to the outer surface of the band when the extended strap has been inserted through the buckle and folded back against the band.

4 Claims, 1 Drawing Sheet

Fig. 1
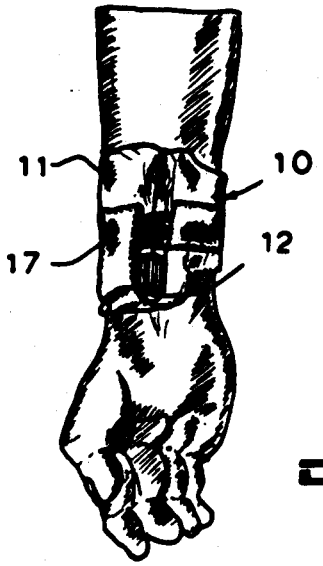
Fig. 2
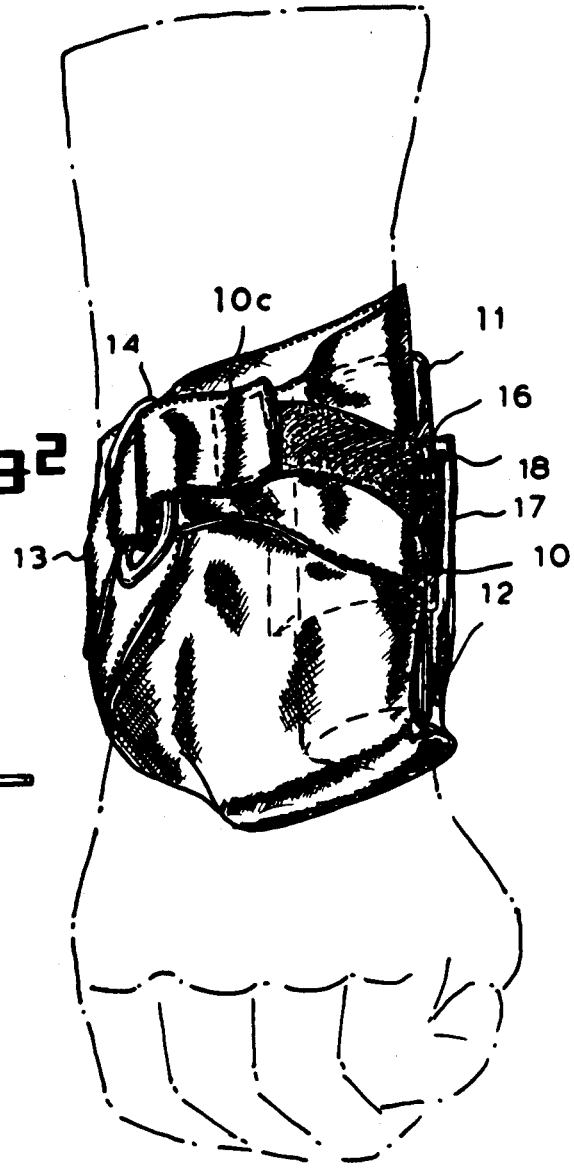
Fig. 3
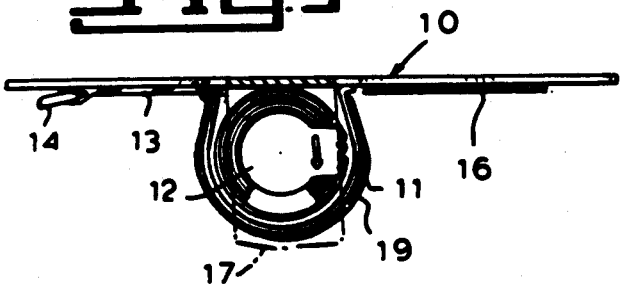
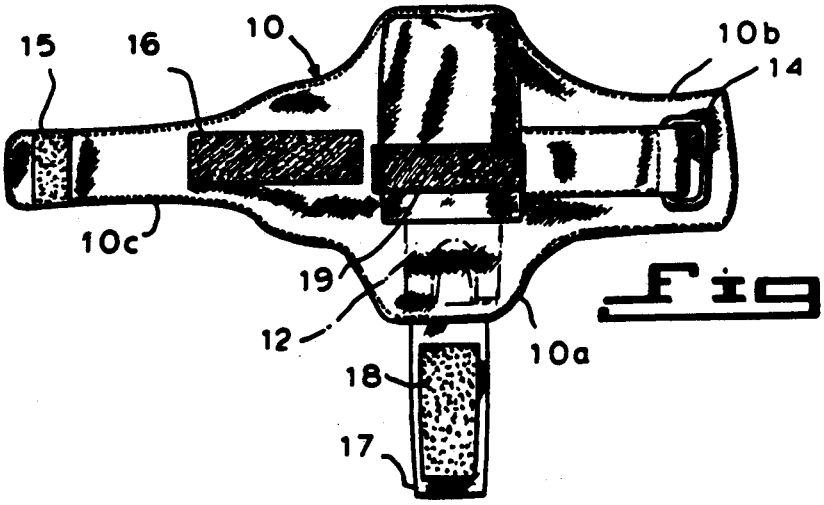
Fig. 4

WRIST HOLSTER

This is a continuation of application Ser. No. 266,396 filed Nov. 2, 1988, now abandoned.

BACKGROUND OF THE INVENTION

This invention relates to a wrist holster that is easily secured to the wrist or forearm with one hand and adjusted to the desired tightness and, more particularly, to a wrist holster of that type, which is adapted to carry a protective gas canister.

Wristbands for carrying cases are disclosed in French Patent No. 508,163, issued Aug. 11, 1920, and British Specification No. 138,701, accepted Feb. 19, 1920. U.S. Pat. No. 1,851,750, issued Mar. 29, 1932, discloses a waterproof case which may be worn on the arm or ankle of a swimmer. U.S. Pat. No. 4,069,954, issued Jan. 24, 1978, discloses a golfer's wristband for carrying tees and ball position markers. U.S. Pat. No. 4,239,136, issued Dec. 16, 1980, discloses a wristband having a key holder.

The need for a convenient device for transporting a protective gas canister, such as a tear gas canister, has also been recognized. U.S. Pat. No. 4,504,980, dated Mar. 19, 1985, discloses a handband secured by a Velcro fastener and having a Velcro palm strip for securing a tear gas canister wrapped in a Velcro jacket.

SUMMARY OF THE INVENTION

The present invention provides a wrist holster which includes a wristband having a pouch which is particularly adapted for carrying a protective gas canister, such as a tear gas canister, in a transverse position relative to the wristband. The wristband is secured by a fastener, such as a pressure sensitive fastener. The canister pouch is closed by a fold-back closure secured by a quick release fastener, such as a pressure sensitive fastener, so that the gas canister is held securely and concealed from view while permitting the foldback closure to be quickly opened for access to the gas canister.

DESCRIPTION OF THE DRAWING

The following figures of the drawing illustrate the preferred mode of the invention and make possible an understanding of the structure, principle of operation and the advantages thereof:

FIG. 1 is a perspective view of the wrist holster of the present invention secured to the forearm;

FIG. 2 is a perspective view of the wrist holster viewed from the opposite side of the forearm;

FIG. 3 is a plan view of the wrist holster, showing the foldback closure in broken lines; and FIG. 4 is a front elevational view of the wrist holster.

DETAILED DESCRIPTION OF THE INVENTION

The wrist holster of the present invention includes a flexible wristband 10 for encircling the forearm. A pouch 11 is provided on the outer surface of the wristband. The pouch extends transversely of the wristband, and the open end of the pouch extends toward the wearer's hand. A gas canister 12 is shown accommodated within the pouch.

The wristband 10 is relatively wide at the intermediate portion **10*a* which carries the pouch 11 and includes a wrap-around portion 10*b* at one end and an extended strap 10*c*** at the opposite end. The wrap-around portion

**10*b* includes a buckle supporting band 13 secured to the outer surface of the wristband at one end and unsecured to the outer surface of the band at the end which carries a buckle 14**.

The wristband 10 is easily applied to the forearm by wrapping the portion **10*b* around the forearm and inserting the extended strap 10*c* through the buckle 14 and then folding the strap back to tighten the band on the forearm. When the strap has been tightened, it is secured by pressing a Velcro strip 15 on the outer surface of the wristband at the end of the strap against a relatively long Velcro strip 16 carried on the outer surface of the wristband intermediate the pouch 11 and the Velcro strip 15**.

The tear gas canister is secured in the pouch by a transversely extending closure 17 secured to the edge of the band. The closure and the span of the band portion **10*a* between the open end of the pouch and inner end of the closure are folded back over the canister to cover and secure it tightly in the pouch against longitudinal or rotational displacement. The closure 17 is secured by pressing a transverse Velcro strip 18 on the closure against a Velcro strip 19** on the outer surface of the pouch.

If the trigger of the gas canister is rotatable to a safety position, the gas canister will be secured tightly in the pouch in the safety position by the fold-back band portion **10*a* so that it will not fire accidentally. In the event of emergency, quick access can be had to the gas canister by opening the closure 17**.

The invention has been shown in a single preferred form and by way of example, and many variations and modifications can be made within the spirit of the invention. For example, a conventional pin and hole type buckle can be used for securing the band to the wrist, and a snap fastener can be used for the closure 17. The invention, therefore, is not intended to be limited to a particular form or embodiment except insofar as such limitations are expressly set forth in the claims.

I claim:

1. In combination, a canister shaped in a cylinder of pre-selected length containing gas of the type used to repel intruders and assailants, and a holster therefor, said holster comprising a wristband formed of a single piece of fabric having an inner and an outer surface, said wristband comprising a central portion, a first band of substantially lesser width than said central portion extending in a first direction from said central portion and having a first outer terminus, a second band of substantially lesser width than said central portion extending therefrom in a direction opposite said first band and having a second outer terminus, said central portion having top and bottom parallel edges tapering inward to merge with the lesser width of said first and second bands, a buckle on said outer surface, first means fixing said buckle in place vicinal said first outer terminus, second means vicinal said second outer terminus engageable with said buckle to tighten said holster around the wrist of the wearer in a variety of positions, a pouch fixed to said outer surface on said central portion shaped complementary to said cylinder and of a length less than said pre-selected length to retain a substantial portion but not all of said canister with said canister extending transversely relative to said first and second bands, one end of said pouch being open and an end of said canister extending out of said pouch for easy gripping by the wearer, and third means on said central portion detachably retaining said canister in said pouch, said third means being quickly releasable, said third means comprising a closure strap fixed to a margin of said central portion adjacent said open end of said pouch and extending outwardly therefrom, said closure strap being substantially narrower than said central portion, said closure strap being foldable to extend over the outside of said pouch, said closure strap being capable of being inserted inside said pouch whereby said closure strap may be folded back to close off said open end to retain said canister in said pouch, said pouch having an outer pouch surface, said third means being located on said outer surface of said wristband and one surface of said closure strap, said pouch comprising a piece of fabric of pre-selected width having opposite side edges and one end fixed to said central portion, the width of said piece of fabric between said side edges being sufficient so that said canister can fit between said piece of fabric and said central portion.

2. The combination of claim 1 in which said first means comprises a supporting strip on said outer surface extending outward from said pouch toward said first outer terminus of said first band and around said buckle, said supporting strip being fixed to said central portion and said first band, said second means comprising a first Velcro-like substance near said outer surface of said second band adjacent said second outer terminus of said second band and an elongated second Velcro-like substance, said Velcro-like substances having opposed ends, there being a substantial space between the adjacent ends of said first and second Velcro-like substances, said first band being substantially wider than said second band, said second band being dimensioned so that its terminus may be inserted through said buckle and doubled back so that said Velcro-like substance may be inter-engaged in a variety of positions of adjustment dependent on the size of the wrist of the wearer.

3. The combination of claim 1 in which said closure strap has an underside opposite said outer surface said third means further comprises a first Velcro-like material on said outer pouch surface of said pouch and second Velcro-like material on the underside of said closure strap, said first and second Velcro-like materials being inter-engageable.

4. The combination of claim 1, in which said top and bottom edges of said central portion taper inwardly in generally concave shapes to merge with the lesser width of said first band, and said top and bottom edges taper inwardly in a first concave curve and then in a convex curve to merge with the lesser width of said second band.

* * * * *